US005219309A

United States Patent [19]

Hart

[11] Patent Number: 5,219,309

[45] Date of Patent: Jun. 15, 1993

[54] INFLATABLE AMUSEMENT RING

[76] Inventor: LeRoy Hart, 9340 NE. 76th St., Vancouver, Wash. 98662

[21] Appl. No.: 726,249

[22] Filed: Jul. 5, 1991

[51] Int. Cl.[5] ..... B63C 9/00

[52] U.S. Cl. ..... 441/136; 441/131; 472/134

[58] Field of Search ..... 441/35, 65, 66, 67, 441/80, 88, 106, 108, 125, 129, 130, 131, 136, 132; 272/76

[56] References Cited

U.S. PATENT DOCUMENTS

| | | | |
|---|---|---|---|
| 763,518 | 6/1904 | Tann | 441/131 |
| 1,561,916 | 11/1925 | Ernst | 441/131 |
| 2,665,519 | 8/1950 | Burkes . | |
| 2,707,102 | 4/1955 | Wendt . | |
| 3,332,415 | 4/1964 | Ericson . | |
| 3,493,228 | 2/1970 | Hicks et al. . | |
| 3,972,526 | 8/1976 | Cox, Jr. . | |
| 4,077,625 | 3/1978 | Clarke . | |
| 4,619,620 | 10/1986 | Felter | 441/131 |
| 4,799,910 | 1/1989 | Kellough | 441/131 |

OTHER PUBLICATIONS

*Kransco* 1986, Sales Catalog (cover page and p. 17).

Copyright 1985, by Kransco, 160 Pacific Avenue, San Francisco, Calif. 94111.

*Kransco* 1988, Sales Catalog (cover page and p. 27).

Copyright 1987, by Kransco, P.O. Box 884866, San Francisco, Calif. 94188.

*Primary Examiner*—Jesus D. Sotelo

*Assistant Examiner*—Stephen P. Avila

*Attorney, Agent, or Firm*—Kolisch, Hartwell, Dickinson, McCormack & Heuser

[57] ABSTRACT

A bouncer ring amusement toy is disclosed in the form of an air-inflatable annular ring. The ring is designed to extend around the torso of a person to form a bouncing cushion, allowing the person to engage in bouncing amusement activities. The dimensions of the ring, including the size of the central opening, the diameter of the outer perimeter, and the thickness of the ring, relate to the size of the intended user. In other words, an adult-sized version of the ring is larger than one designed for use by a child. Handles are provided on the ring to allow the user to securely grip the ring while engaging in bouncing activities.

8 Claims, 1 Drawing Sheet

INFLATABLE AMUSEMENT RING

BACKGROUND AND SUMMARY OF THE INVENTION

This invention relates to recreational and amusement toys and more particularly to an inflatable toy in the form of a ring.

Various types of children's amusement devices have taken the form of an inflatable ring designed to surround the user. Probably the best-known such device is the automotive inner tube. Patents have been granted on other types of inflatable ring toys, for example, U.S. Pat. No. 3,493,228, which is an inflatable ring fitted with hanging rattles and other objects for use by infants.

The inventor of the present invention has developed an improved type of ring-shaped toy which is shaped differently from an inner tube and which can be used to create new, fun, bouncing games and other activities.

The invention provides an amusement toy comprising an air-inflatable annular ring for extending around a human torso. The ring is formed of flexible, air-impervious sheet material having a generally toroidal shape, including a central opening and a generally circular outer perimeter. The dimensions of the ring, including its width and the size of the central opening, are substantially different from that of an automotive inner tube. In the present invention, the ring, when inflated, is sized to fit closely around the torso of the user and to extend outwardly approximately the length of the user's arm. The ring is sized for use by an intended user who is within a predetermined size range, the size relationship between the ring and user being approximately the following: (a) the circumference of the central opening generally corresponds to the circumference of the torso of a person the size of the intended user, (b) the outer perimeter of the ring is spaced from the central opening a distance approximately equal to or greater than the length of an arm of a person the size of the intended user, and (3) the cross-sectional thickness of the ring is approximately equal to or greater than the diameter of the central opening. The result is a relatively wide, thick ring with a small central opening, as compared with that of an automotive inner tube. With the user positioned in the central opening, the ring forms a wide annular cushion about the user's torso, permitting the user to engage in bouncing amusement activities.

DETAILED DESCRIPTION OF THE PREFERRED EMBODIMENT

Figure 1:
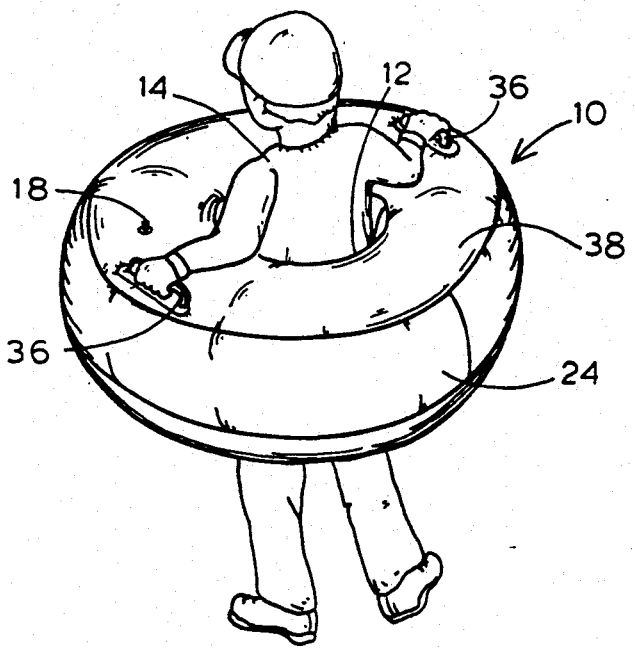
FIG. 1 is a perspective view showing the amusement toy of the present invention in place around the torso of a child.

Referring to FIG. 1, the amusement toy of the present invention is an air-inflatable annular ring 10, called a bumper ring or bouncer ring, which has a generally toroidal shape (i.e., doughnut-shape). The central opening 12 of bouncer ring 10 is sized to fit relatively closely around the torso of a child or other user 14. FIG. 1 shows the typical position of ring 10 around user 14, when the ring is in use.

Figure 2:
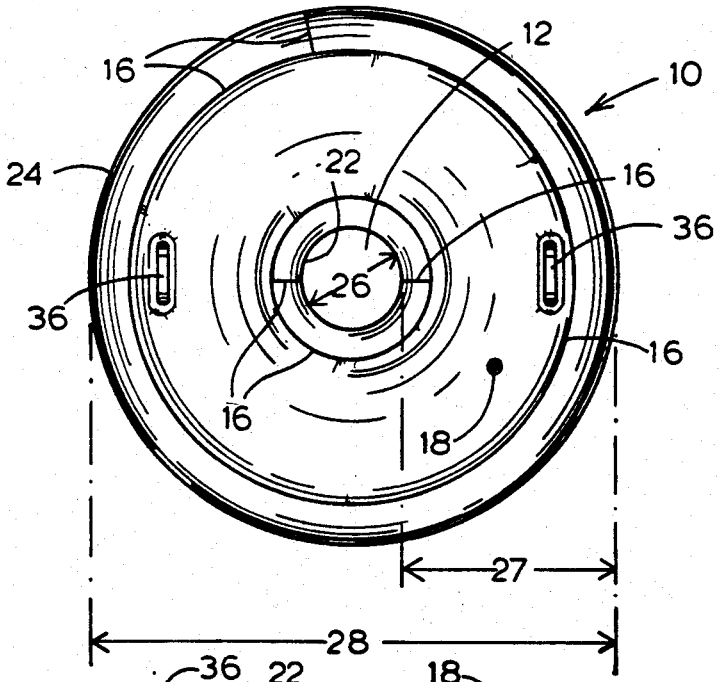
FIG. 2 is a top plan view of the ring of FIG. 1, slightly enlarged.
Figure 3:
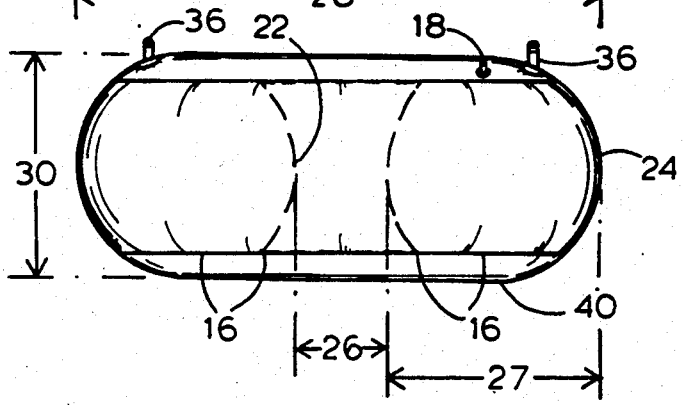
FIG. 3 is a side elevation of the amusement toy as shown in FIG. 2.

Referring to FIGS. 2 and 3, ring 10 is an annular envelope of air-impervious sheet material, such as vinyl, plastic, polyethylene or the like. Typically, a plurality of separate sheets of the sheet material, cut or formed in suitable shapes, are joined together to create the annular envelope. The exact location of the seams, where the edges of the sheets are joined to one another, is a matter of design choice, within the knowledge of those skilled in the art. By way of example, seams 16 indicated in FIGS. 2 and 3 are representative of suitable locations for the boundaries between individual sheets of the plastic sheet material which makes up ring 10. The separate sheets are joined together along seams 16 by heat sealing or another suitable technique. An air inlet/-outlet aperture and valve 18, of any suitable type, is provided on ring 10 for inflation/deflation of the ring.

When bouncer ring 10 is inflated, as shown in FIGS. 1–3, it forms a wide, fat, annular body. Inflation of ring 10 by admitting air into valve 18 results in a certain bulbousness to the shape of the ring, as the flat panels of plastic sheet material which make up the ring bulge outwardly due to interior pressure. As a consequence, the walls of central opening 12 curve inwardly into the central opening, with the narrowest point in central opening 12 being approximately mid-way through the opening, at innermost edge 22. Similarly, the outer perimeter 24 of ring 10 bulges outwardly when the ring is inflated.

Ring 10 has an annular width 27 (the width of the ring measured from inner edge 22 to outer perimeter 24) which exceeds the diameter 26 of central opening 12, measured across inner edge 22. The overall diameter 28 of outer perimeter 24 exceeds three times the diameter of 26 of central opening 12. The cross-sectional thickness 30 of ring 10, meaning the thickness through the body of the ring at its thickest point, approximately equals or exceeds the diameter 26 of central opening 12. Preferably, ring thickness 30 exceeds twice the diameter 26 of central opening 12. As such, ring 10 has a considerably bulkier shape and appearance than an automotive inner tube, the latter generally having a large central opening relative to its annular width and thickness. Bouncer ring 10 is a wide, thick annular body designed to provide a cushioning effect for a user positioned in central opening 12.

The size dimensions of bouncer ring 10, including the diameter 26 of central opening 12, annular width 27, the overall diameter 28, the circumference of outer perimeter 24, and the ring thickness 30, are scaled to fit the intended user of the ring. In other words, the ring, when inflated, is sized to fit an intended user who falls within a predetermined size range. Preferably, the dimensions of ring 10 relate to the size of the intended user approximately as follows:

(a) The circumference of central opening 12, at its narrowest point along inner edge 22, should generally correspond to the circumference of the torso or waist of a person the size of the intended user. That does not necessarily mean the ring offers a snug or tight fit around the torso of the user, nor does it mean the circumference of central opening 12 must be small enough to contact the user around the entire circumference of the opening. Since bouncer ring 10 is soft and resilient, and opening 12 is tapered and has an hour-glass shape, it is preferable that opening 12 be sized to approximately equal the circumference of the torso or waist of the user, within a range of plus or minus 50% of the user's circumference. Accordingly, the circumference of central opening 12 preferably is between approximately one-half the circumference of the torso of a person the size of the intended user and one-and one-half times the circumference of the torso such person.

(b) The outer perimeter 24 of the ring should be spaced from the inner edge 22 of central opening 12 (such spacing being the annular width 27) a distance approximately equal to or greater than the length of the arm of a person the size of the intended user. In other words, the annular width 27 of bouncer ring 10 should be great enough to generally equal or exceed the outer reach of the user's arms, when the user's arms are outstretched. In this specification, the length of a user's arm is measured between the shoulder and the wrist of the user.

(c) Finally, the cross-sectional thickness 30 of ring 10, measured at its thickest point, should be approximately equal to or greater than the diameter 26 of central opening 12. Such a thickness will provide bouncer ring 10 with the volume desireable for cushioning the user during collisions and other types of bouncing games.

The above size relationships are not intended to be an exact ratio of ring dimensions 26, 27 and 30 to the arm length and torso size of the user, but they represent guidelines which should be followed to perhaps approximately plus-or-minus 50% of the referenced dimension on the user's body. It is anticipated that bouncer ring 10 will be available in perhaps two or three different sizes, at least one being sized for children between 8 and 12 years of age and another for larger children or adults. Each ring size will fit an intended user whose size is within a predetermined range, as determined by the average size range of individuals in the intended user's age group.

An example of suitable dimensions for a bouncer ring 10 sized to fit a child in the 8- to 12-year-old age group, such as a 10-year-old boy with a 26-inch waist size and 16-inch-long arms (measured from shoulder to wrist), would be the following: Bouncer ring 10 will have a central opening diameter of 8-inches, measured across inner edge 22, an overall ring diameter 28 (i.e., the diameter of outer perimeter 24) of 48-inches, an annular width 27 of 20-inches, and a thickness 30 of 18-inches. A bouncer ring 10 of that size will be suitable for use by medium-sized children whose size is within the following predetermined range: A torso circumference (i.e., waist) of between 18-inches and 30-inches, and arms between approximately 14-inches and 28-inches long.

As noted above, dimensions 26, 27, 28 and 30 shown in FIGS. 2 and 3 refer to the dimensions of the ring when inflated, which tends to bulge the outside perimeter outwardly and the edge of central opening 12 inwardly. Consequently, the above-discussed dimensions do not represent the dimensions of the pieces of sheet material from which ring 10 is made.

As a second example, a large child's or adult-sized bouncer ring 10, designed for someone with a 34-inch waist and arms from 28-inches to 34-inches long, would preferably have approximately the following dimensions: A central opening diameter of 11-inches, an outside diameter around outer perimeter 24 of 62-inches, and a thickness of 22-inches.

It is anticipated that bouncer rings of various sizes will have dimensions that fall within the following approximate ranges: A central opening diameter of between about 6-inches and 12-inches, an outside diameter 28, around outer periphery 24, of between about 40-inches and 64-inches, and a thickness of between about 8-inches and 24-inches. Rings made within those approximate dimensional guidelines will provide a cushioning effect around the user's torso in accordance with the present invention.

To facilitate use of bouncer ring 10 and to help position the ring relative to the user, ring 10 is preferably equipped with a pair of gripping handles 36 on the annular top surface 38 of ring 10. Handles 36 are preferably made of plastic, plastic sheet material, or the like, with suitable affixing pads provided on the base of the handles so they can be attached to the sheet material of the ring by heat sealing or an equivalent attachment method, Handles 36 are preferably disposed on opposite sides of central opening 12, oriented transverse to the diameter of the ring, as shown in the figures. The handles can be gripped by the user to position and steady the ring as the user engages in bouncing collisions or other activities. Additional handles (not shown) can be provided at other suitable locations on top surface 38, and can also be provided on the annular bottom surface 40, if desired, allowing the bouncer ring 10 to be used in an inverted orientation.

Bouncer ring 10 is in entertaining amusement device for children and others, allowing users to engage in imaginative bouncing games and other activities. A child or other user will generally step into central opening 12, grasp handles 36 and raise the ring to a comfortable height. Since the ring is air-inflated and made of lightweight vinyl or other sheet material, it generally weighs less than five pounds, when inflated. Once raised by the user to a comfortable height surrounding the torso, bouncer ring 10 forms a wide, thick annular body which provides a cushioning effect, allowing children to safely collide with one another or roll themselves along on the periphery of the ring. The ring can be deflated for storage. In addition, the bouncer ring can be made from or covered with brightly colored stripes, designs, words, logos or advertisements.

Alternative embodiments are possible within the scope of the present invention. As noted above, the rings can be made in various sizes to accommodate individuals in different size ranges. The bouncer ring can also be made in a variety of shapes, for example, with an oval or rectangular outer perimeter, or can be provided with inflatable projections which add interest to the appearance of the ring. The outer perimeter could be covered with texturing or contours to produce interesting designs. The suggested placement of gripping handles on the top surface could be modified to include handles closer to the outer periphery of the ring, or closer to the central opening. Other changes within the scope of the present invention will occur to those skilled in the art.

While the present invention has been shown and described with reference to the foregoing preferred embodiment, it will be apparent to those skilled in the art that other changes in form and detail may be made without departing from the scope and spirit of the invention, as defined in the appended claims.

What is claimed is:

1. A bouncer ring amusement toy, comprising:

an air-inflatable annular ring for extending around a human torso to cushion the torso while the user engages in bouncing amusement activities, the ring including a toroidal envelope of flexible, air-impervious sheet material having an open, circular central opening and a generally circular outer perimeter which produces a cushioning effect during bouncing collisions, and including handles attached to the ring for grasping by a user positioned in the said central opening;

the ring, when inflated, being sized to fit an intended user whose size is within a predetermined range, the size relationship being approximately as follows:

(a) the circumference of said central opening generally corresponds to the circumference of the torso of a person the size of the intended user, (b) the outer perimeter of the ring is spaced from said central opening a distance approximately equal to or greater than the length of an arm of a person the size of the intended user, and (c) the cross-sectional thickness of the ring is approximately equal to or greater than the diameter of said central opening, whereby the ring, when an intended user is positioned in said central opening, forms a wide annular cushion about the user's torso to permit bouncing amusement activities.

2. An amusement toy as in claim 1 in which the ring has an annular top surface extending between said central opening and said outer perimeter, said handles being attached to said top surface on opposite sides of said central opening.

3. A bouncer ring amusement toy, comprising:

an air-inflatable annular ring for extending around a human torso to cushion the torso while the user engages in bouncing amusement activities, the ring including a toroidal envelope of flexible, air-impervious sheet material having an open, circular central opening and a generally circular outer perimeter which produces a cushioning effect during bouncing collisions, the ring, when inflated, being sized to fit an intended user whose size is within a predetermined range, the size relationship being approximately as follows:

(a) the circumference of said central opening generally corresponds to the circumference of the torso of a person the size of the intended user, (b) the outer perimeter of the ring is spaced from said central opening a distance approximately equal to or greater than the length of an arm of a person the size of the intended user, (c) the cross-sectional thickness of the ring is approximately equal to or greater than the diameter of said central opening, whereby the ring, when an intended user is positioned in said central opening, forms a wide annular cushion about the user's torso to permit bouncing amusement activities, and (d) said central opening of the ring has a diameter in the range of central opening of the ring has a diameter in the range of between about 6-inches and 12-inches, the outer perimeter has a diameter in the range of between about 40-inches and 64-inches, and the cross-sectional thickness of the ring is between about 8-inches and 24-inches.

4. A bouncer ring amusement toy, comprising:

an air-inflatable annular ring for extending around a human torso to cushion the torso while the user engages in bouncing amusement activities, the ring including a toroidal envelope of flexible, air-impervious sheet material having an open, circular central opening and a generally circular outer perimeter which produces a cushioning effect during bouncing collisions, the ring, when inflated, being sized to fit an intended user whose size is within a predetermined range, the size relationship being approximately as follows:

(a) the circumference of said central opening is between approximately one-half the circumference of the torso of a person the size of the intended user and one-and-one-half times the circumference of the torso of a person the size of the intended user, whereby the circumference of the central opening generally corresponds to the circumference of the torso of the intended user, (b) the outer perimeter of the ring is spaced from said central opening a distance approximately equal to or greater than the length of an outstretched arm of a person the size of the intended user, measured between the shoulder and wrist of such person, and (c) the cross-sectional thickness of the ring is approximately equal to or greater than the diameter of said central opening, whereby the ring, when an intended user is positioned in said central opening, forms a wide annular cushion about the user's torso to permit bouncing amusement activities.

5. A bouncing amusement toy for cushioning the torso of a user during bouncing amusement activities, consisting of:

an air-inflatable toroidal envelope having an open, circular central opening surrounded by the body of the toroidal envelope to form a ring for extending around a the torso of a user positioned in said central opening, the ring being formed of flexible, air-impervious sheet material which, when inflated, produces a cushioning effect during bouncing collisions, and wherein the ring has an annular width, as measured between the edge of the central opening and the outer peripheral of the ring, which exceeds the diameter of the central opening, and has a cross-sectional thickness which approximately equals or exceeds the diameter of the central opening, the ring thereby forming a wide, thick annular body which provides a cushioning effect for a user positioned in said central opening to permit bouncing amusement activities, and handles attached to the ring for grasping by a user positioned in said central opening.

6. An amusement toy as in claim 5 in which the ring is sized to fit around the torso of an intended user who is within a predetermined size range, the size of said central opening being such that the circumference of the central opening generally corresponds to or exceeds the circumference of the intended user's torso.

7. An amusement toy as in claim 6 in which the outer perimeter is approximately the same distance from said central opening as the end of an intended user's outstretched arm, when the user is positioned in said central opening.

8. An amusement as in claim 5 in which the ring has an annular top surface extending between said central opening and said outer perimeter, said handles being attached to said top surface on opposite sides of said central opening.

* * * * *